US005220977A

United States Patent [19]

Wolner

[11] Patent Number: 5,220,977

[45] Date of Patent: Jun. 22, 1993

[54] FALL INDICATOR FOR USE WITH FALL ARRESTING DEVICES

[75] Inventor: James T. Wolner, Red Wing, Minn.

[73] Assignee: D B Industries, Inc., Red Wing, Minn.

[21] Appl. No.: 837,871

[22] Filed: Feb. 18, 1992

[51] Int. Cl.[5] ..... A62B 33/00

[52] U.S. Cl. ..... 182/18

[58] Field of Search ..... 182/18, 3-5

[56] References Cited

U.S. PATENT DOCUMENTS

| | | | |
|---|---|---|---|
| 4,253,544 | 3/1981 | Dalmaso | 182/18 X |
| 4,538,702 | 9/1985 | Wolner | 182/3 |
| 4,660,679 | 4/1987 | Ostrobrod . | |
| 4,877,110 | 10/1989 | Wolner | 182/18 X |

*Primary Examiner*—Alvin C. Chin-Shue
*Attorney, Agent, or Firm*—Moore & Hansen

[57] ABSTRACT

A fall indicating device including an indicating portion that is normally retained within the body of the fall indicator. Upon the exertion of sufficient force upon the fall indicator, as, for example, from the forces generated during fall arrest, a restraining member within the body of the fall indicator, such as a shear pin or a series of disk springs, releases the indicating portion, alerting the user that the fall restraining device has been subjected to fall arrest forces. In the case of fall indicator using a shear pin, the indicator may require replacement after being subjected to fall arrest forces. However, a fall indicator using a spring or series of disk springs may be reset after use without needing to be replaced.

The fall indicating device may also be integrally attached to a connecting member such as a snap hook. When integrally connected to a snap hook, the snap hook, using the free end of the fall indicator, may be attached to the line or cable issuing from a safety device such as a self retracting lifeline.

52 Claims, 4 Drawing Sheets

FALL INDICATOR FOR USE WITH FALL ARRESTING DEVICES

BACKGROUND OF THE INVENTION

1. Technical Field

The present invention relates generally to indicators that disclose at a glance whether a fall arresting device has been subjected to fall arresting forces 2. Background Information It is generally considered good practice, and is, in fact, a federal law in some trades, that if a personal fall protection system or component has been subjected to fall arrest forces, it must be removed from service for inspection or repair, or may even need to be destroyed. However, a number of systems or components do not afford a positive means that will indicate whether such forces have been applied. Another problem that is associated with a class of devices known as self retracting lifelines ("SRL's") is that due to their extensive range, even if they incorporated an indicator on the SRL housing, it is often not visible to the user. This is because the unit is often mounted high overhead. Therefore, there is a need for an indicator that will positively identify that a fall has occurred and that may be placed in close proximity to the user. Such an indicator could be used on many components such as a lanyard, trolley, horizontal line, rope grab, hoist or harness. It is also envisioned that such an indicator could be used in situations where materials rather than personnel are actively protected from falls.

The fall indicator of the present invention overcomes the difficulties described above and affords other features and advantages heretofore not available.

SUMMARY OF THE INVENTION

The fall indicating device of the present invention includes an indicating portion that is normally retained within the body of the fall indicator Upon the exertion of sufficient force upon the fall indicator, as, for example, from the forces generated during fall arrest, a restraining member within the body of the fall indicator, such as a shear pin or a series of disk springs, releases the indicating portion, alerting the user that the fall restraining device has been subjected to fall arrest forces. In the case of fall indicator using a shear pin, the indicator may require replacement after being subjected to fall arrest forces. However, a fall indicator using a spring or series of disk springs may be reset after use without needing to be replaced.

The fall indicating device may also be integrally attached to a connecting means such as a snap hook. When integrally connected to a snap hook, the snap hook, using the free end of the fall indicator, may be attached to the line or cable issuing from a safety device such as a self retracting lifeline. As with a conventional snap hook, the modified snap hook with integral fall indicator is free to swivel on the cable, the swivel portion being located between the fall indicator portion and the snap hook portion. In the preferred embodiment of the modified snap hook, the fall indicator also inhibits the free rotation of the snap hook with respect to the indicator portion thereof, thereby providing both visual and functional indication that the fall restraining device has been subjected to fall arrest forces.

It is an object of this invention to provide the user of a fall protection device with an indicator that indicates that the fall protection device has been subjected to fall arrest forces. It is a further object of this invention that the fall indicator be conveniently located so as to permit easy viewing thereof, without requiring the user to view the actual fall protection device directly, the fall arrest device frequently being located in an inconvenient location, such as attached to an overhead structure far above the location of the user.

Other objects and advantages of the invention will become apparent from the following detailed description and from the appended drawings in which like numbers have been used to describe like parts throughout the several views.

DESCRIPTION OF THE PREFERRED EMBODIMENT

Figure 2:
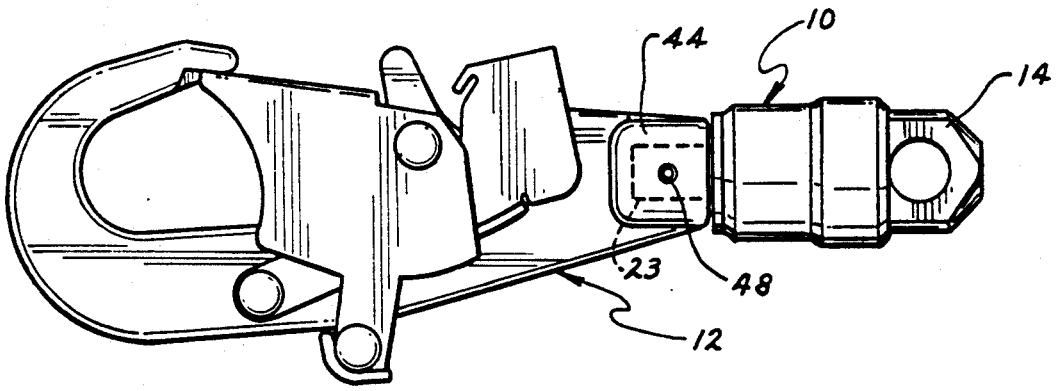
FIG. 2 is a side elevation of the fall indicator integrally connected to a snap hook.

With reference to the drawings, and in particular to FIG. 2, the fall indicator for use with fall arresting devices is generally indicated by reference numeral 10. Fall indicator 10 is shown mounted to a snap hook 12.

Figure 1:
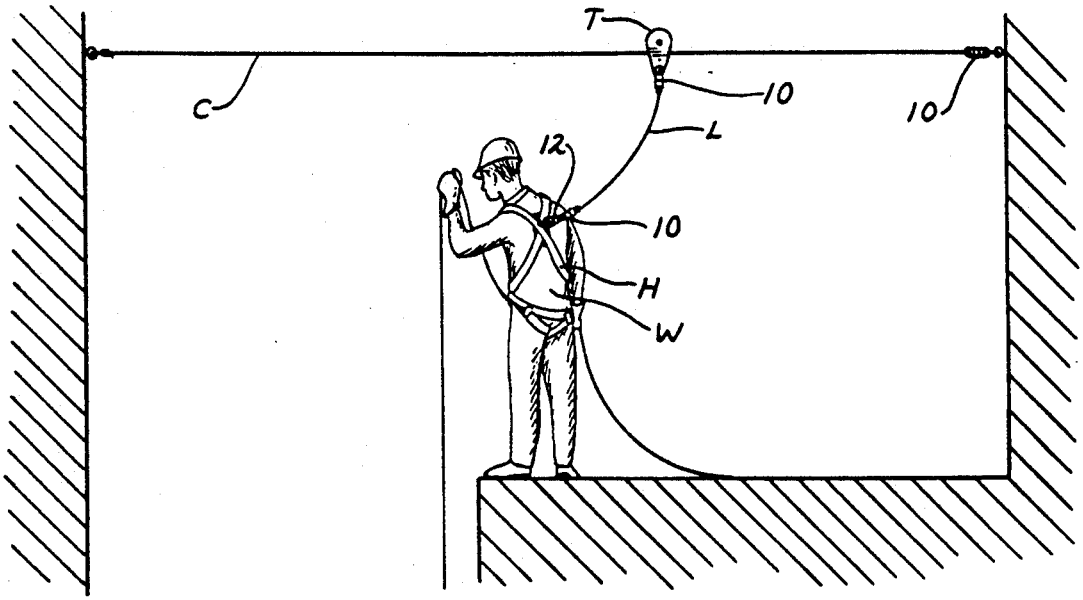
FIG. 1 is a side elevation of a worker illustrating several possible uses of the fall indicator of the present invention.

FIG. 1 illustrates a number of possible locations for positioning fall indicator 10. While fall arrest systems may not always utilize more than a single fall indicator 10, their effectiveness is increased by making redundant use of them. For example, fall indicator 10 may be mounted to snap hook 12, as shown in FIG. 2. Snap hook 12 may then be releasably attached to a belt or harness H worn by worker W. Here, worker W is shown attached to a fixed-length lanyard L which may be directly connected to a trolley T that may roll along cable C. In the event worker W should fall, fall indicator 10 attached to snap hook 12 would activate, indicating that trolley T requires inspection. Alternatively, fall indicator 10 may be attached directly to trolley T with lanyard L suspended from fall indicator 10 on one end, the other end being attached to snap hook 12 on harness H of worker W. In the event of a fall, fall indicator 10 on trolley T would indicate that trolley T requires inspection. Finally, the system illustrated may include a fall indicator 10 of the type illustrated in FIG. 2A attached to the end of cable C from which trolley T is suspended. Again, in the event worker W should fall, fall indicator 10 attached to cable C would activate, indicating that trolley T requires inspection.

Several other alternative arrangements may also be envisioned, using other safety devices, including the use of a self retracting lifeline suspended from fall indicator 10 which is in turn suspended from an overhead anchorage point. A self retracting lifeline offers greater flexibility than the above-described trolley T, since the self retracting lifeline may pay out more line as the worker travels from the safety device Should the worker fall, the force on the self retracting lifeline would be passed on to the fall indicator 10, causing it to activate It should be understood, however, that it is preferred that fall indicator 10 be located in an easily observed location, preferably near the worker, to permit of easy and frequent viewing of fall indicator 10.

Figure 2A:
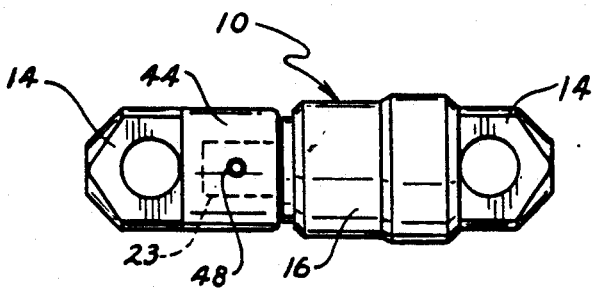
FIG. 2A is a side elevation of the fall indicator illustrated in FIG. 2 configured as a stand-alone component.
Figure 3:
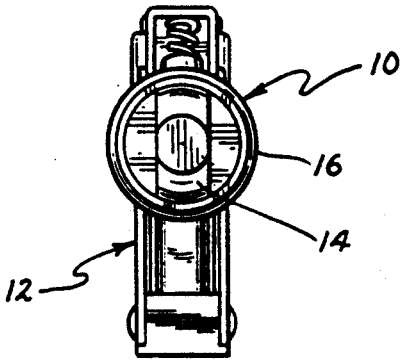
FIG. 3 is an end elevation of the fall indicator illustrated in FIG. 2.
Figure 4:
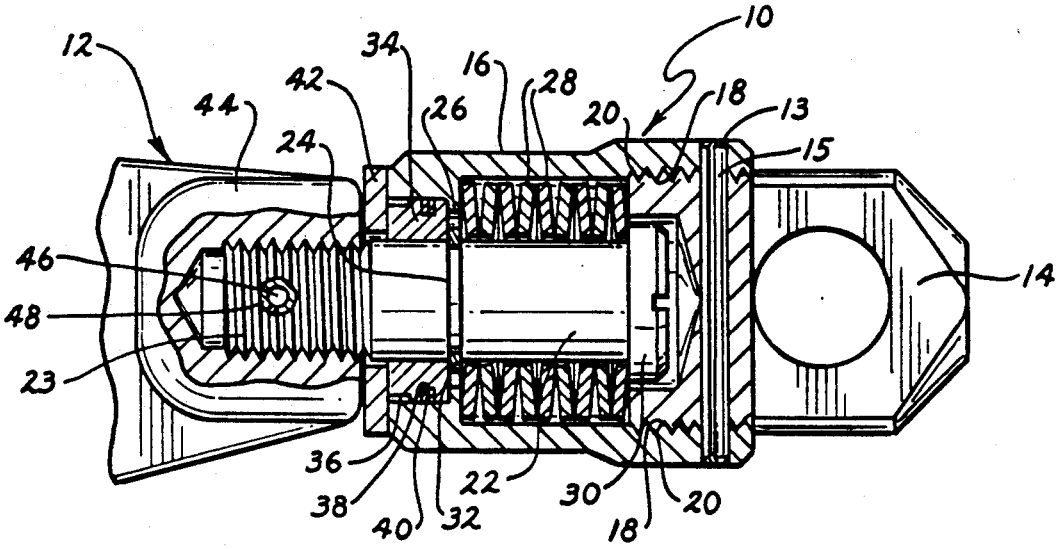
FIG. 4 is a section view of the preferred embodiment of the fall indicator.
Figure 5:
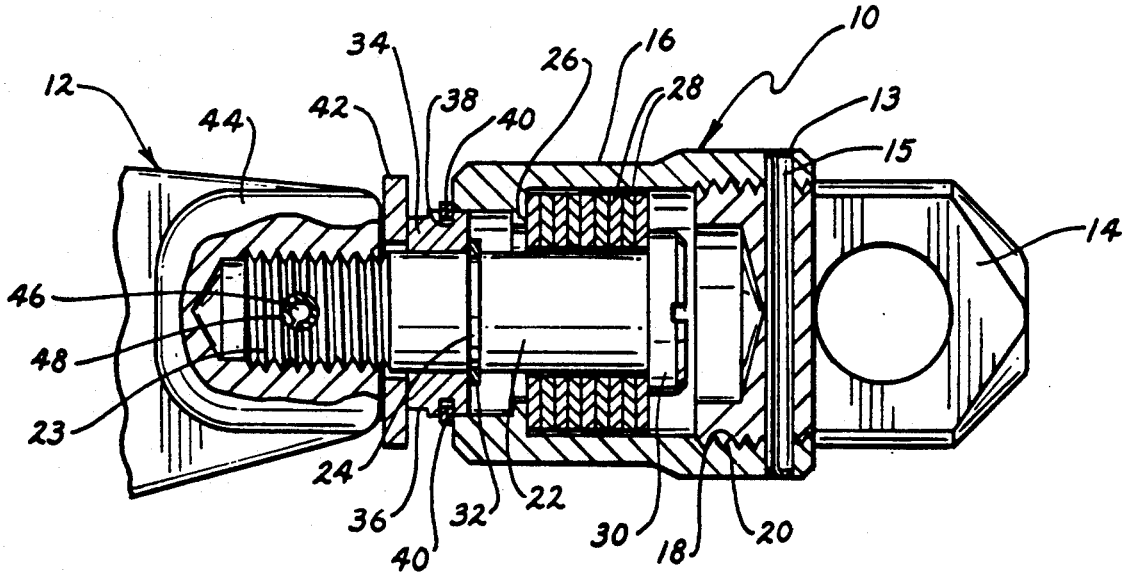
FIG. 5 is a section view of the fall indicator illustrated in FIG. 4 after the fall indicator has been exposed to fall arresting forces.

The preferred embodiment of fall indicator 10 is illustrated in FIGS. 4 and 5. Projecting from at least one end of fall indicator 10 is swivel eye 14. Swivel eye 14 includes external threads 18 that engage internal threads 20 of generally cylindrical body 16. Swivel eye 14 is only threaded to body 16 after the remaining internal components, to be described, have been properly inserted Upon completion of assembly of fall indicator 10, hole 13 is drilled through body 16 and swivel eye 14, and spring pin 15 is inserted therein to securely retain swivel eye 14 in the proper position. Partially contained within and projecting from body 16 is bolt 22, including threaded portion 23, to which may be engaged snap hook 12, another device such as trolley T, or a second swivel eye similar to swivel eye 14, as illustrated in FIG. 2A. Bolt 22 includes a circumferential groove 24, which shall be discussed.

The interior of body 16 defines a chamber between swivel eye 14 and circumferential inward projection 26 within which are retained several disk springs 28. Bolt 22 also passes through disk springs 28, which also bear against the head 30 of threaded bolt 22. Nested in groove 24 is retaining ring 32, against which bears indicator ring 34. Indicator ring 34 is slidably mounted to threaded bolt 22. Indicator ring 34 includes a circumferential colored band 36. It is preferred that colored band 36 be painted red for easy observation, although other colors or techniques may be used for rendering that portion of indicator ring 34 easily observable.

Indicator ring 34 also includes a circumferential groove 38 in which is positioned expandable spiral retaining ring 40. In the illustrated embodiment, washer 42, which bears against snap hook 12, maintains indicator ring in its position abutting retaining ring 32. As illustrated in FIG. 4, washer 42 permits snap hook 12 to rotate with respect to fall indicator 10.

Threaded portion 23 of bolt 22 is threadedly received within bolt receiving portion 44 of snap hook 12. Upon completion of assembly of fall indicator 10 to snap hook 12, hole 46 is drilled through bolt receiving portion 44 of snap hook 12 and threaded portion 23 of bolt 22. Spring pin 48 is inserted therein to securely retain fall indicator 10 in the proper location.

During normal operation, fall indicator 10 maintains the configuration illustrated in FIG. 4, with colored band 36 of indicator ring 34 concealed within body 16. However, upon exposure to fall arrest forces, which induce stress forces along the length of fall indicator 10, the resistance of disk springs 28 is overcome and fall indicator 10 is deformed to the configuration illustrated in FIG. 5, with colored band 36 of indicator ring 34 exposed outside of body 16. At the same time, spiral retaining ring 40 expands, preventing indicator ring 34 from being drawn back into body 16 by disk springs 28 upon the removal of the fall arrest forces. An additional feature of the preferred embodiment of fall indicator 10 is that when indicator ring 34 projects from body 16 as illustrated in FIG. 5, snap hook 12 is no longer free to rotate with respect to fall indicator 10. This is because of disk springs 28, the row of which bears against head 30 of bolt 22 on one end, and against inward projection 26 of body 16 on the other. Body 16 is in turn biased against indicator ring 34 through spiral retaining ring 40. Indicator ring 34 bears against washer 42, which is in turn biased against bolt receiving portion 44 of snap hook 12. The failure of snap hook 12 to rotate with respect to fall indicator 10 following exposure to fall arrest forces provides an additional indication to the user that the safety device may require service or replacement.

It is important to understand that fall indicator 10 is intended to notify the user that a safety device such as trolley T illustrated in FIG. 1 has been exposed to fall arrest forces and may require maintenance or replacement before further use. Thus, fall indicator 10 may be calibrated to the particular requirements of the safety device with which it is being used. Fall indicators 10 may therefore be configured in varying dimensions, with various numbers or sizes of disk springs 28, to satisfy the particular requirements of the safety device with which it is being used. In the event that the particular safety device is exposed to forces less than those requiring maintenance or replacement of the safety device, indicator ring 34 may partially withdraw from housing 16 while the safety device is subject to those forces, but it will then return to the concealed position illustrated in FIG. 4 immediately upon removal of those forces.

Figure 6:
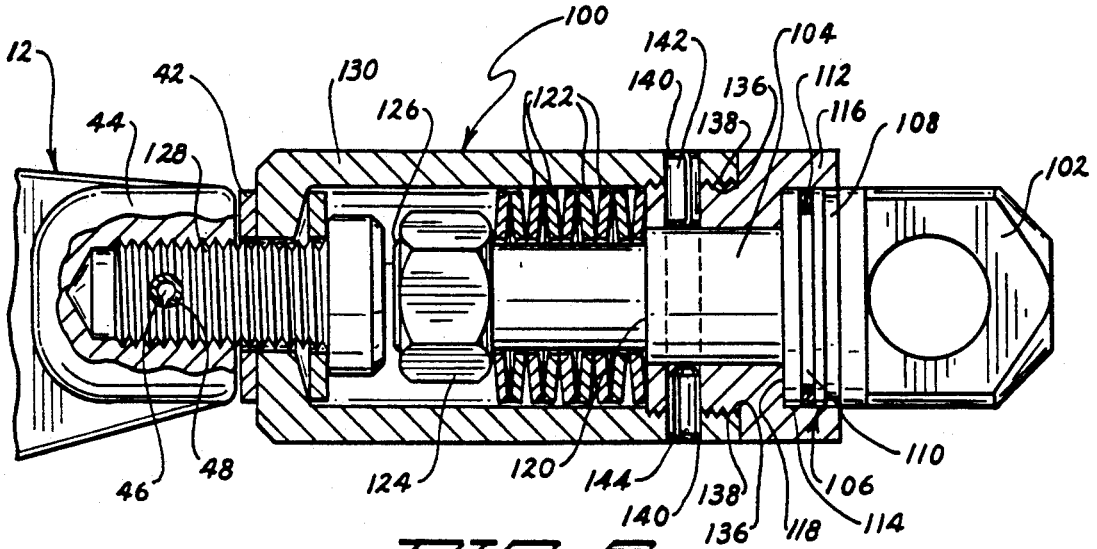
FIG. 6 is a section view of a second embodiment of the fall indicator.
Figure 7:
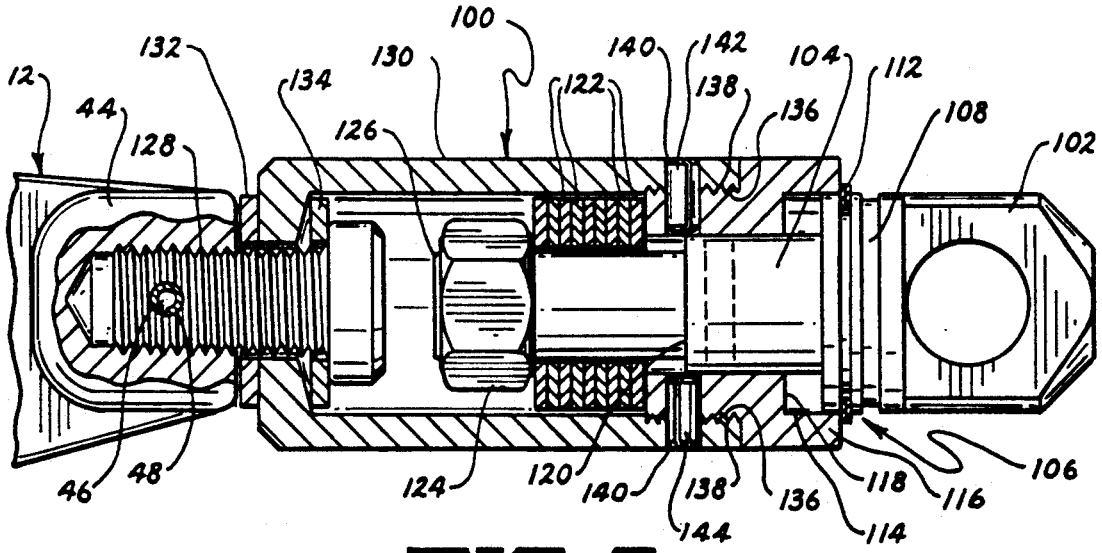
FIG. 7 is a section view of the fall indicator illustrated in FIG. 6 after the fall indicator has been exposed to fall arresting forces.

FIGS. 6 and 7 illustrate a second embodiment 100 of the fall indicator. Projecting from at least one end of fall indicator 100 is swivel eye 102, which is preferably mounted to and integral with the end of eye bolt 104. Adjacent eye 102 on eye bolt 104 is indicator portion 106, including colored band 108 and circumferential groove 110. Captured within groove 110 is spiral retaining ring 112. As may be seen in FIG. 6, during normal use, indicator portion 106 remains concealed within recess 114 of body nut 116. Further, indicator portion 106 rests against shoulder 118 of body nut 116. Eye bolt 104 also includes a shoulder 120 against which are positioned disk springs 122. Disk springs 122 are retained in position against shoulder 120 and body nut 116 on the one end by nut 124 on the other end, which engages threaded portion 126 of eye bolt 104.

In the embodiment illustrated in FIGS. 6 and 7, anchor bolt 128 projects from the end of generally cylindrical body 130 opposite swivel eye 102. Washers 132, 134 permit a rotatable relation between fall indicator 100 and snap hook 12. As with other embodiments of fall indicator 100 that are attachable to a snap hook 12, anchor bolt 128 is retained in a fixed position by spring pin 48 positioned in hole 46 that is drilled through anchor bolt 128 and bolt receiving portion 44 of snap hook 12.

After passing eye bolt 104 through body nut 116, disk springs 116 are positioned on eye bolt 104, and nut 124 is engaged to the threaded portion 126 thereof. Body nut 116 includes external threads 136 that engage internal threads 138 of body 130. Body nut 116 is only threaded to body 130 after the remaining internal components have been properly inserted. Upon completion of assembly of all indicator 100, hole 140 is drilled through body 130, body nut 116 and eye bolt 140. First spring pin 142 is inserted in one end of hole 140 and second spring pin 144 is inserted in the other end of hole 140. It is very important that spring pins 142, 144 be positioned so as not to extend into the portion of hole 140 contained in eye bolt 104 (shown in broken lines in FIGS. 6 and 7) to ensure proper operation of fall indicator 100. Permitting hole 140 to pass through eye bolt 104 enables spring pins 142, 144 to be pressed out of fall indicator 100 in the event it requires disassembly.

During normal operation, fall indicator 100 maintains the configuration illustrated in FIG. 6, with colored band 108 of indicator portion 106 concealed within recess 114 of body nut 116. However, upon exposure to fall arrest forces, which induce stress forces along the length of fall indicator 100, the resistance of disk springs 122 is overcome and fall indicator 100 is deformed to the configuration illustrated in FIG. 7, with colored and 108 of indicator portion 106 exposed outside recess 114 of body nut 116. At the same time, spiral retaining ring 112 expands, preventing indicator portion 106 from being drawn back into recess 114 of body nut 116 by disk springs 122 upon the removal of the fall arrest forces.

Figure 8:
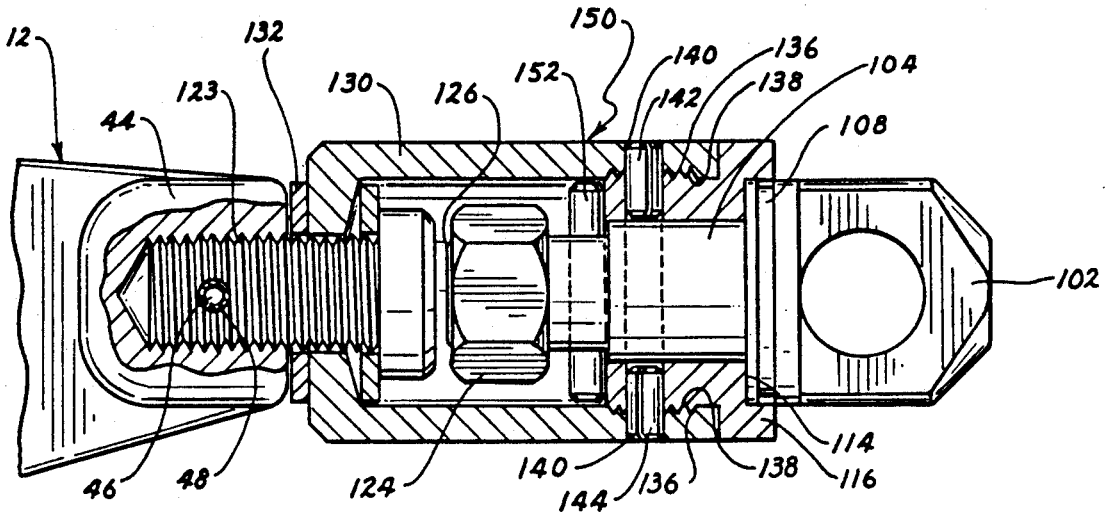
FIG. 8 is a section view of a third embodiment of the fall indicator.
Figure 9:
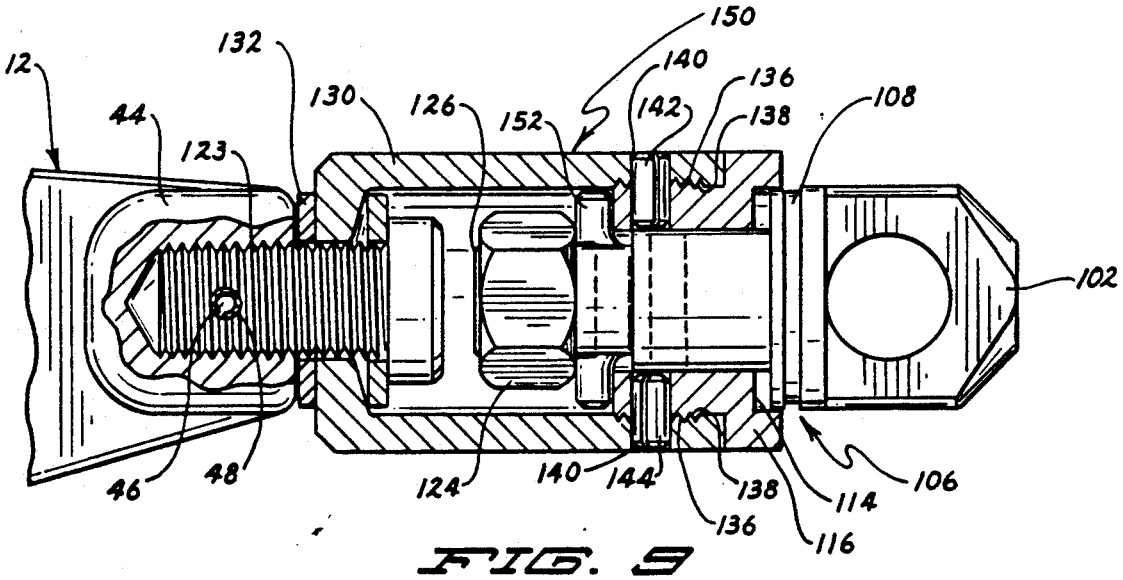
FIG. 9 is a section view of the fall indicator illustrated in FIG. 8 after the fall indicator has been exposed to fall arresting forces.

FIGS. 8 and 9 illustrate a third embodiment 150 of the fall indicator, which is very similar in construction to fall indicator 100. The major difference between the second and third embodiments of the fall indicator is the replacement of disk springs 122 with a shear pin 152. Upon exposure to fall arrest forces, which induce stress forces along the length of fall indicator 150, the resistance of shear pin 152 is overcome and fall indicator 150 is deformed to the configuration illustrated in FIG. 9, with colored band 108 exposed outside recess 114 of body nut 116. The embodiment of fall indicator 150 illustrated in FIGS. 8 and 9 does not include the spiral retaining ring 112 shown in FIG. 6 and 7 for preventing indicator portion 106 from being drawn back into recess 114 of body nut 116. This is because there are no springs in fall indicator 150 acting to urge indicator portion 106 back into recess 114. Unlike other embodiments of the fall indicator, fall indicator 150 may not simply be reset after use by adjusting retaining ring 32, 112. Instead, shear pin 152 must be replaced or, preferably, fall indicator 150 must be discarded after use.

While the preferred embodiments of the invention have been described, it should be understood that various changes, adaptations, and modifications may be made therein without departing from the spirit of the invention and the scope of the appended claims.

What is claimed is:

1. A device for indicating whether a fall protection apparatus for bearing a load has been subjected to fall arrest forces, the device comprising:

a housing having a first end and as second end, said first end opposably positioned from said second end; indicator means concealed within said housing;

first retaining means for retaining said indicator means within said housing;

first attachment means associated with said first end of said, housing;

second attachment means associated with said second end of said housing; and second retaining means for retaining said indicator means outside of said housing, whereby upon exposure of the fall protection apparatus to fall arrest forces, said first retaining means releases said indicator means from within said housing, rendering said indicator means visible to the user of the fall protection apparatus, and said second retaining means prevents said indicator means from being retracted within said housing by said first retaining means;

2. The fall indicator device disclosed in claim 1, further comprising:

a projecting member projecting from said first end of said housing, said projecting member having a first end and a second end, said indicator means being fixedly associated with an intermediate portion of said projecting member, said second end of said projecting member being retained within said housing by said first retaining means and said first attachment means being attachable to said first end of said projecting member.

3. The fall indicator device disclosed in claim 2, further comprising:

a chamber within said housing, said second end of said projecting member being retained within said chamber;

a first annular member projecting within said chamber from the wall of said chamber; and a second annular member projecting from said second end of said projecting member, said first retaining means bearing against said first and second annular members to retain said projecting member within said housing;

4. The fall indicator device disclosed in claim 3, wherein said first retaining means comprises:

spring means positioned about said projecting member.

5. The fall indicator device disclosed in claim 4, wherein said spring means comprises:

a plurality of disk springs, each said disk spring having an open central portion, said projecting member passing through said open central portions of said disk springs.

6. The fall indicator device disclosed in claim 2, wherein said indicator means comprises:

an indicator ring fixedly engaged with said projecting member, said indicator ring having an indicator portion.

7. The fall indicator device disclosed in claim 6, wherein said second retaining means comprises:

an annular groove on the exterior of said indicator ring, said annular groove positioned between said indicator portion and said first retaining means; and a spiral retaining ring positioned within and projecting from said annular groove, whereby upon exposure of the fall protection apparatus to fall arrest forces, said indicator ring projects from said first end of said housing and said spiral retaining ring expands and bears against said first end of said housing upon the release of the fall arrest forces, preventing said first retaining means from drawing said projecting member, and said indicator ring fixedly engaged therewith, back into said housing.

8. The fall indicating device disclosed in claim 2, further comprising:

a closure member removably engaging said second end of said housing to provide access to said projecting member, said indicator means associated therewith and said second retaining means, said second attachment means being integral with said closure member.

9. The fall indicating device disclosed in claim 8, wherein:

said closure member threadably engages said second end of said housing.

10. The fall indicator device disclosed in claim 9, further comprising:

fixing means for fixing the position of said closure member relative to said housing.

11. The fall indicating device disclosed in claim 10, wherein said fixing means comprises:

a pin member passing through said closure member and the walls of said housing.

12. The fall indicating device disclosed in claim 8, wherein said second attachment means comprises:

an eye bolt projecting outwardly from said housing.

13. The fall indicating device disclosed in claim 1, wherein:

said first attachment means is attached to a snap hook.

14. The fall indicating device disclosed in claim 2, wherein:

said first end of said projecting member threadably engages a snap hook.

15. The fall indicating device disclosed in claim 14, further comprising:

fixing means for fixing the position of said snap hook relative to said projecting member.

16. The fall indicating device disclosed in claim 15, wherein said fixing means comprises:

a pin member passing through said projecting member and the threaded walls of said snap hook.

17. The fall indicating device disclosed in claim 1, wherein:

said first attachment means is attached to an eye bolt projecting outwardly from said housing.

18. The fall indicating device disclosed in claim 2, wherein said first attachment means comprises:

an eye bolt threadably engaging said first end of said projecting member.

19. The fall indicating device disclosed in claim 18, further comprising:

fixing means for fixing the position of said eye bolt relative to said projecting member.

20. The fall indicating device disclosed in claim 19, wherein said fixing means comprise:

a pin member passing through said projecting member and the disclosed walls of said eye bolt.

21. A device for indicating whether a fall projection apparats for bearing a load has been subjected to fall arrest forces, the device comprising:

a housing having a first end and a second end, said first end opposably positioned from said second end;

a closure member removably engaging said second end of said housing; indicator means concealed within said closure member;

first retaining means for retaining said indicator means within said closure member;

first attachment means associated with said first end of said housing;

second attachment means associated with said second end of said housing; and second retaining means for retaining said indicator means outside of said housing, whereby upon exposure of the fall protection apparatus to fall arrest forces, said first retaining means releases said indicator means from within said closure member, rendering said indicator means visible to the user of the fall protection apparatus, and said second retaining means prevents said indicator means from being retracted within said closure member by said first retaining means.

22. The fall indicating device disclosed in claim 21, further comprising:

a first projecting member projecting from said first end of said housing, said first projecting member having a first end and a second end, said first attachment means being attachable to said first end of said first projecting member and said second end of said first projecting member having a first annular member projecting therefrom; and a second projecting member projecting from said closure member, said second projecting member having a first end and a second end, said indicator means being fixedly associated with an intermediate portion of said second projecting member, said first end of said second projecting member being retained within said housing by said first retaining means, and said second attachment means being attachable to said second end of said second projecting member, said first end of said second projecting member having a second annular member projecting therefrom.

23. The fall indicating device disclosed in claim 22, further comprising:

a chamber within said housing, said second end of said first projecting member and said first end of said second projecting member being retained within said chamber, said closur member providing access to said chamber, said closure member having an opening through which passes said second projecting member, said first retaining means bearing against said closure member and said second annular member to retain said second projecting member within said housing.

24. The fall indicating device disclosed in claim 23, wherein said first retaining means comprises:

spring means positioned about said second projecting member.

25. The fall indicating device disclosed in claim 24, wherein said spring means comprises:

a plurality of disk springs, each said disk spring having an open central portion, said second projecting member passing through said open central portions of said disk springs.

26. The fall indicating device disclosed in claim 22, wherein said indicator means comprises:

an indicator ring fixedly engaged with said second projecting member, said indicator ring having an indicator portion.

27. The fall indicating device disclosed in claim 26, wherein said second retaining means comprises:

an annular groove on the exterior of said indicator ring, said annular groove positioned between said indicator portion and said first retaining means; and a spiral retaining ring positioned within and projecting from said annular groove, whereby upon exposure of the fall protection apparatus to fall arrest forces, said indicator ring projects from said closure member and said spiral retaining ring expands and bears against said closur member upon the release of the fall arrest forces, preventing said first retaining means from drawing said second projecting member, and said indicator ring fixedly engaged therewith, back into said housing and said closure member, respectively.

28. The fall indicating device disclosed in claim 21, wherein:

said closure member threadedly engages said second end of said housing,

29. The fall indicating device disclosed in claim 28, further comprising:

fixing means for fixing the position of said closure member relative to said housing.

30. The fall indicating device disclosed in claim 29, wherein said fixing means comprises:

a first pin member passing through a wall of said housing and through an adjacent wall of said closure member; and a second pin member passing through a wall of said housing opposably positioned to said first pin member and through an adjacent wall of said closure member.

31. The fall indicating device disclosed in claim 22, wherein said second attachment means comprises:

an eye bolt projecting outwardly from said housing.

32. The fall indicating device disclosed in claim 22, wherein:

said first end of said first projecting member threadedly engages a snap hook.

33. The fall indicating device disclosed in claim 32, further comprising:

fixing means for fixing the position of said snap hook relative to said first projecting member.

34. The fall indicating device disclosed in claim 33, wherein said fixing means comprises:

a pin member passing through said first projecting member and the threaded walls of said snap hook.

35. The fall indicating device disclosed in claim 22, wherein said first attachment means comprises:

an eye bolt threadedly engaging said first end of said first projecting member.

36. The fall indicating device disclosed in claim 35, further comprising:

fixing means for fixing the position of said eye bolt relative to said first projecting member.

37. The fall indicating device disclosed in claim 36, wherein said fixing means comprises:

a pin member passing through said first projecting member and the threaded walls of said eye bolt.

38. A device for indicating whether a fall protection apparatus for bearing a load has been subjected to fall arrest forces, the device comprising:

a housing having a first end and a second end, said first end opposably positioned from said second end;

a closure member removably engaged said second end of said housing;

indicator means concealed within said closure member;

retaining means for retaining said indicator means within said closure member;

first attachment means associated with said first end of said housing; and second attachment means associated with said second end of said housing, whereby upon exposure of the fall protection apparatus to fall arrest forces, said retaining means releases said indicator means from within said closure member, rendering said indicator means visible to the user of the fall protection apparatus.

39. The fall indicating device disclosed in claim 38, further comprising:

a first projecting member projecting from said first end of said housing, said first projecting member having a first end and a second end, said first attachment means being attachable to said first end of said first projecting member and said second end of said first projecting member having a first annular member projecting therefrom; and a second projecting member projecting from said closure member, said second projecting member having a first end and a second end, said indicator means being fixedly associated with an intermediate portion of said second projecting member, said first end of said second projecting member being retained within said housing by said retaining means, and said second attachment means being attachable to said second end of said second projecting member, said first end of said second projecting member having as second annular member projecting therefrom.

40. The fall indicating device disclosed in claim 39, further comprising:

a chamber within said housing, said second end of said first projecting member and said first end of said second projecting member being retained within said chamber, said closure member providing access to said chamber, said closure member having an opening through which passes said second projecting member, said retaining means bearing against said closure member to retain said second projecting member within said housing.

41. The fall indicating device disclosed in claim 40, wherein said retaining means comprises:

a pin member passing through said second projecting member.

42. The fall indicating device disclosed in claim 39, wherein said indicator means comprises:

an indicator ring fixedly engaged with said second projecting member, said indicator ring having an indicator portion.

43. The fall indicating device disclosed in claim 38, wherein:

said closure member threadedly engages said second end of said housing.

44. The fall indicating device disclosed in claim 43, further comprising:

fixing means for fixing the position of said closure member relative to said housing.

45. The fall indicating device disclosed in claim 44, wherein said fixing means comprises:

a first pin member passing through a wall of said housing and through an adjacent wall of said closure member; and a second pin member passing through a wall of said housing opposably positioned to said first pin member and through an adjacent wall of said closure member.

46. The fall indicating device disclosed in claim 39, wherein said second attachment means comprises:

an eye bolt projecting outwardly from said housing.

47. The fall indicating device disclosed in claim 39, wherein:

said first end of said first projecting member threadedly engages a snap hook.

48. The fall indicating device disclosed in claim 47, further comprising:

fixing means for fixing the position of said snap hook relative to said first projecting member.

49. The fall indicating device disclosed in claim 48, wherein said fixing means comprises:

a pin member passing through said first projecting member and the threaded walls of said snap hook.

50. The fall indicating device disclosed in claim 39, wherein said first attachment means comprises:

an eye bolt threadedly engaging said first end of said first projecting member.

51. The fall indicating device disclosed in claim 50, further comprising:

fixing means for fixing the position of said eye bolt relative to said first projecting member.

52. The fall indicating device disclosed in claim 51, wherein said fixing means comprises:

a pin member passing through said first projecting member and the threaded walls of said eye bolt.

* * * * *

UNITED STATES PATENT AND TRADEMARK OFFICE

CERTIFICATE OF CORRECTION

PATENT NO. : 5,220,977

DATED : June 22, 1993

INVENTOR(S) : J. Thomas Wolner

It is certified that error appears in the above-indentified patent and that said Letters Patent is hereby corrected as shown below:

ln 39, col 1, insert -- . -- after the word "indicator".

ln 2, col 5, delete "all" and insert -- fall -- therefor.

ln 3, col 5, delete "140" after bolt and insert -- 104 -- therefor.

ln 20, col 5, delete "and" after colored and insert -- band -- therefor.

ln 39, col 5, delete "FIG." and insert -- FIGS. -- therefor.

claim 1, ln 57, col 5, delete "as" and insert -- a -- therefor.

claim 1, ln 59, col 5, start new paragraph after "end;" beginning with "indicator".

claim 1, ln 64, col 5, delete " , " after the word "said".

claim 2, ln 9, col 6, delete "indicator" and insert -- indicating -- therefor.

claim 3, ln 20, col 6, delete "indicator" and insert -- indicating -- therefor.

claim 4, ln 33, col 6, delete "indicator" and insert -- indicating -- therefor.

UNITED STATES PATENT AND TRADEMARK OFFICE

CERTIFICATE OF CORRECTION

PATENT NO. : 5,220,977

DATED : June 22, 1993

INVENTOR(S) : J. Thomas Wolner

It is certified that error appears in the above-indentified patent and that said Letters Patent is hereby corrected as shown below:

claim 5, ln 37, col 6, delete "indicator" and insert -- indicating -- therefor.

claim 6, ln 43, col 6, delete "indicator" and insert -- indicating -- therefor.

claim 7, ln 48, col 6, delete "indicator" and insert -- indicating -- therefor.

claim 10, ln 7, col 7, delete "indicator" and insert -- indicating -- therefor.

claim 14, ln 23, col 7, delete "threadably" and insert -- threadedly -- therefor.

claim 18, ln 39, col 7, delete "threadably" and insert -- threadedly -- therefor.

claim 20, ln 46, col 7, delete "comprise" and insert -- comprises -- therefor.

claim 20, ln 48, col 7, delete "disclosed" and insert -- threaded -- therefor.

claim 21, ln 56, col 7, start new paragraph after "housing;" beginning with "indicator".

claim 23, ln 33, col 8, delete "closur" and insert -- closure -- therefor.

claim 27, ln 65, col 8, delete "closur" and insert -- closure -- therefor.

UNITED STATES PATENT AND TRADEMARK OFFICE

CERTIFICATE OF CORRECTION

PATENT NO. : 5,220,977

DATED : June 22, 1993

INVENTOR(S) : J. Thomas Wolner

It is certified that error appears in the above-indentified patent and that said Letters Patent is hereby corrected as shown below:

claim 38, ln 54, col 9, delete "engaged" and insert -- engaging -- therefor.

claim 39, ln 20, col 10, delete "as" after having and insert -- a -- therefor.

Signed and Sealed this

Fifteenth Day of March, 1994

*Attest:*

*Attesting Officer*

Bruce Lehman

BRUCE LEHMAN

*Commissioner of Patents and Trademarks*